United States Patent [19]

Olsen

[11] 4,344,533

[45] Aug. 17, 1982

[54] FIFTH PANEL RECLOSABLE PACKAGE

[75] Inventor: Peter R. Olsen, Suffern, N.Y.

[73] Assignee: Grinnell Lithographic Co., Inc., Islip, N.Y.

[21] Appl. No.: 172,537

[22] Filed: Jul. 28, 1980

[51] Int. Cl.[3] ..... B65D 5/54; B65D 5/64

[52] U.S. Cl. ..... 206/459; 206/621; 206/626

[58] Field of Search ..... 206/626, 621, 622, 624, 206/625, 459, 634

[56] References Cited

U.S. PATENT DOCUMENTS

| | | | |
|---|---|---|---|
| 1,992,195 | 2/1935 | Daller | 206/625 |
| 2,002,364 | 5/1935 | Daller | 206/622 |
| 3,219,253 | 11/1965 | Davis | 206/624 |
| 3,454,212 | 7/1969 | Elward | 206/626 |
| 4,201,292 | 5/1980 | Davidson et al. | 206/621 |

*Primary Examiner*—William T. Dixson, Jr.
*Attorney, Agent, or Firm*—Bauer & Amer

[57] ABSTRACT

A product containing package having a fifth panel for the support thereof from a display and an integral instruction panel containing information personal to the user of the packaged products, hidden within the closed compartment of the package from viewing until such time as the compartment is opened, at which time the information contained on the instruction panel is immediately presented to view by at least partially obstructing access to the products within the compartment. Included within the package are structure for guiding the insertion of products into the compartment and alerting the user of package tampering.

20 Claims, 10 Drawing Figures

FIFTH PANEL RECLOSABLE PACKAGE

The present invention relates generally to display packaging. More particularly, it relates to improvements in point of sales display packages which assure the proper conveyance to the customer of instruction and necessary descriptive material in the proper use of the packaged products as well as to obviate otherwise undetectable tampering, and to aid in the production assembly of the products into the package.

Pegboard or similar point of sales displays, from which packaged merchandise is supportingly suspended, utilize a "fifth panel" package which includes a product containing compartment that is suspended from the pegboard hook or other support by the fifth panel. Since "fifth panel" pegboard display packaging is not typically closely supervised and is usually displayed in prominent areas, the same are vulnerable to tampering, not just of the products contained therewithin, but also of the package itself. The tendency to tamper with such packages, therefore, severely limits the nature of the products that can be practically displayed since tampering presents formidable risks to the products when the products are of the personal or home care type, such as prophylactics and the like.

In the display and sale of personal and home care products that require explicit instructions as to their use, efforts to provide the required or necessary and helpful information relating to product use by the inclusion of graphic or pictorial illustrations placed within the package of the product often are overlooked, go unheeded or are completely ignored. Because of this, attempts have been made to apply this information to the package exterior. However, the same have offended some members of the public thereby resulting in the removal of the package from display completely and a reduction in sales of the product. Especially important is the reduction and elimination of instances of tampering with the personal and home care product containing packages to assure the efficacy of the product itself.

The desideratum of the present invention is to provide a package that is peculiarly well suited for use as a point of sales display of personal and home care type products that are generally not sold over the counter because of the personal type messages and instructional information that must be displayed and conveyed to the user.

Hence, an object of the present invention is to overcome the problems of the prior art by providing a package which includes an integral instruction panel that is fully enclosed within a closed product containing compartment and initially hidden from public view until such time as the compartment is opened.

Another object of the invention is to provide a package in which the instruction panel is positioned within the product compartment such that when the compartment is opened, the instruction panel is exposed to view and at least partially obstructs access to the compartment interior, thereby requiring the user to read the instructions on the panel before removing any products from the compartment.

A further object of the invention is to provide a fifth panel package in which the fifth panel is employed to reclose the compartment after the same is initially opened. In this connection a feature and object of the invention resides in the provision of a removable tear strip that must be forcefully and deliberately removed from the package when the compartment is to be opened. Any tampering with the package and the tear strip will immediately become apparent and obvious to the purchaser who will be warned of the same. As a consequence, those who might attempt to tamper with packages will tend to be deterred and discouraged from package and product tampering by the present package construction.

Other and further objects of the invention reside in the provision of guide means to guide the insertion of products into the compartment to enhance the filling of the compartment with the products and to prevent accidental insertion of the products into the compartment in such manner as to inhibit the proper functioning of the instruction panel.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

Referring to FIGS. 1 to 7 of the drawings, the package constructed according to the teaching of the invention is generally identified by the numeral 10. Although the package 10 is unusually well adapted for point of display of personal and home care products that generally are not openly displayed in some communities for sale over the counter, the same is not intended and should not be limited to such usage. As the description proceeds, it will be apparent that the package 10 is not intended to be limited to the sale of or for use with any particular products.

Figure 7:
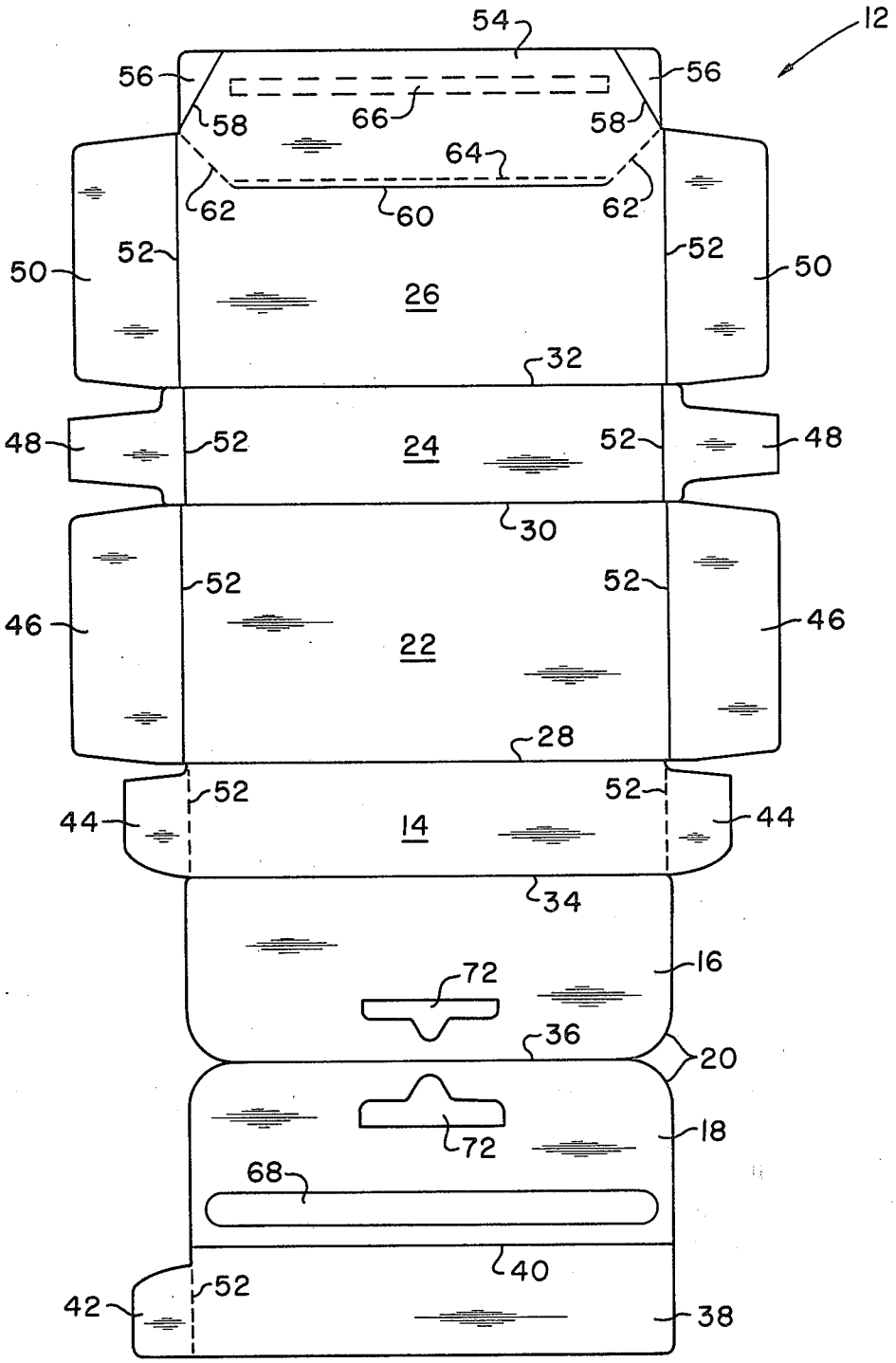
FIG. 7 is a plan view of a flat blank for constructing the package of FIGS. 1 to 6.

The package 10 is initially formed from a die cut blank that is generally identified in FIG. 7 by the numeral 12. The blank 12 is formed of a series of integrally related and connected panels that are joined together at fold lines. Many of the panels also include side flaps which will be described.

Referring to the blank of FIG. 7, the same includes a top panel 14 that is joined on its one side by a front member 16 and a back member 18, both of which members comprise the fifth panel illustrated in FIGS. 1 to 6 by the number 20. The top panel 14 is serially connected at its opposite side to a front panel 22, a bottom panel 24 and a back panel 26. Each of the interconnected panels 14, 22, 24 and 26 are interrupted by fold lines 28, 30 and 32 respectively, thereby permitting each of the aforementioned panels to be joined and folded relative to each other to complete the formation of the package 10 and to form a closed compartment to be defined thereby.

Intermediate the top panel 14 and the back member 16 is a fold line 34 while the front and back members 16 and 18 have a fold line 36 that permits them to bend relative to each other to complete the fifth panel 20. Integrally connected to the fifth panel 20 and more particularly to the back member 18 thereof, as an extension of the fifth panel 20, is an instruction panel 38 that is joined and bendable relative to the fifth panel by a fold line 40. The instruction panel 38 is provided at one of its sides with a flap or guide tab 42 whose function will be described at a later point in this disclosure.

Each of the panels 14, 22, 24 and 26 is provided with an end closure flap at its opposite ends. Thus, the top panel 14 has the opposite closure flaps 44, the front panel 22 has the opposite closure flaps 46. Similarly, the bottom panel 24 includes the closure flaps 48 while the back panel 26 supports and is integral with the end closure flaps 50. Each of the flaps 44, 46, 48 and 50 fold along the lines 52 relative to the panels from which they project.

The back panel 26 has defined on it, and formed as an integral part with it, a removable tear strip 54 which also could be appropriately identified as a removable panel 54, except that during the formation of the blank 12 the tear strip 54 is formed as an inseparable part of the back panel 26. The tear strip 54 has bendable finger tabs or grips 56 at its opposite ends that are capable of being flexed relative to the strip 54 at fold lines 58. Delineating the tear strip 54 from its integral back panel 26 is a cut line 60 which penetrates partially through the thickness of the material of the panel 26, but not fully therethrough. The tear or cut line 60 merges at its opposite ends with a perforation or tear line 62 that is a continuation of the partially through-depth perforation 64. As the description proceeds, it will become apparent that the separation and removal of the tear strip 54 from the back panel 26 requires a release of both the perforations 62 and 64 and the cut line 60 in a manner that will be described.

The inside surface, that is to say, the interior surface of the back panel 26 and more particularly the tear strip 54 is provided with an elongated adhesive surface that is shown in broken lines 66. The adhesive surface 66 engages with and adheres to a complementary adhesive surface 68 that is shown in solid lines on the back member 18 of the fifth panel 20. The blank 12 is now ready to be formed into the partially closed condition as is illustrated in FIG. 3.

Figure 3:
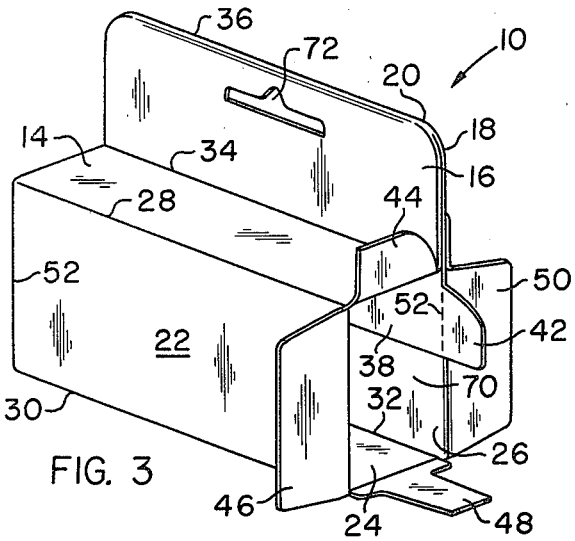
FIG. 3 is a front perspective view illustrating the package with one of its sides open to receive the insertion of products thereinto.

FIG. 3 illustrates the near one of the ends of the package 10 being left open with the end closure flaps thereat fully distended and opened to illustrate the interior product containing compartment 70 to be formed thereby. This is accomplished by folding the members 16 and 18 relative to each other along the line 36. When they are in full surface to surface engagement, an adhesive suitably placed between them will retain them adhered together as a single fifth panel 20 such as is illustrated in FIGS. 1 to 6. When doubled together in that position, their pegboard receiving slot 72, originally formed in each of the members 16 and 18, is now reinforced so as to permit the package 10 to be supported from a pegboard hook or other suitable support (not shown).

Because the instruction panel 38 is an extension of the back member 18, it extends downwardly therefrom in the manner as is illustrated in FIG. 3. The top panel 14, front panel 22, bottom panel 24 and back panel 26 all are bent relative to each other along their respective fold lines so as to bring the adhesive surface 66 into engagement with the complementary adhesive surface 68 on the back member 18 to secure the panels in their initial compartment forming relationship as is illustrated in FIG. 3.

Figure 2:
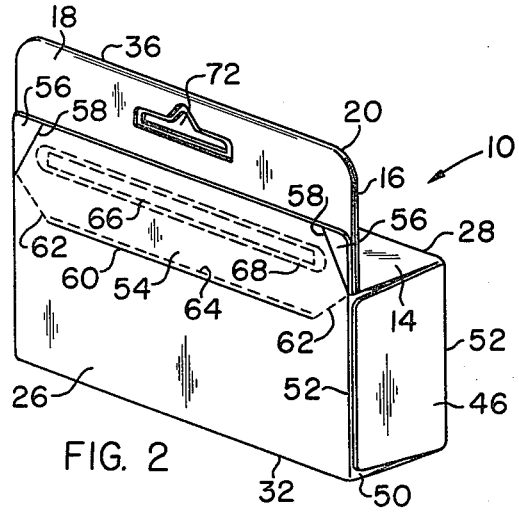
FIG. 2 is a rear perspective view of the package of FIG. 1.
Figure 5:
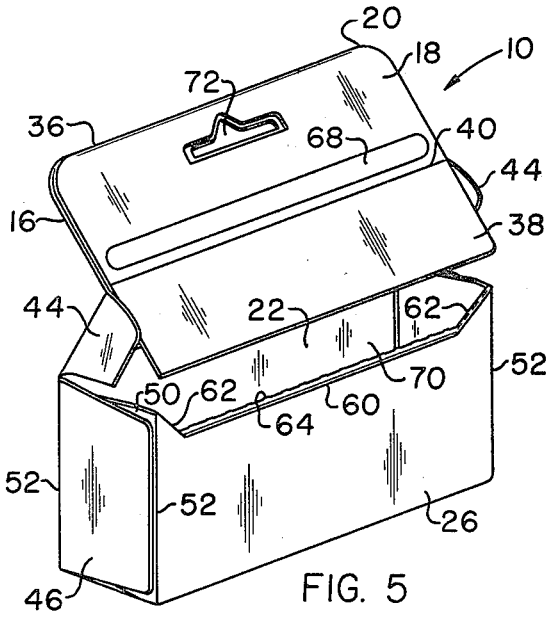
FIG. 5 is a view of the package of FIG. 4 exposing the instruction panel.
Figure 6:
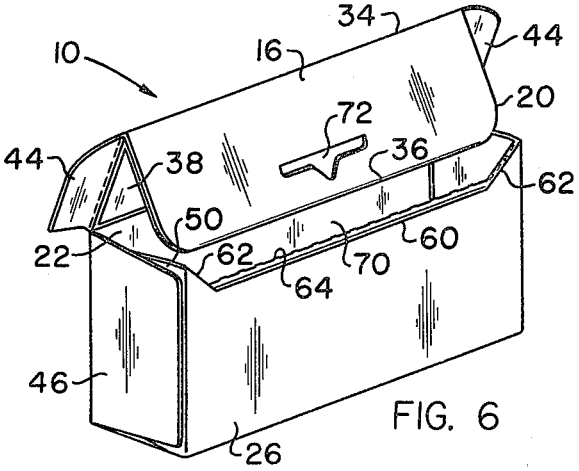
FIG. 6 is a view of the open package with the fifth panel in position to reclose the same.

The side flaps 44, 46, 48 and 50 extending from their respective panels opposite the open end as illustrated in FIG. 3 are bent inwardly toward each other to close their respective end of the compartment 70 and of the package 10. They are thus sealed in this position in the manner as is illustrated in FIGS. 2, 5 and 6 with the flap 46 overlying all the other flaps to form a smooth outer end surface of the package 10.

The near open end of the compartment 70 as illustrated in FIG. 3 is deliberately left open so as to illustrate the function of the flap or guide tab 42. When the compartment 70 is partially enclosed as illustrated in FIG. 3, the guide tab 42 projects outwardly beyond the open end of the compartment 70. This outward projection of the guide tab permits products to be machine fed in a production manner into the open end of the compartment 70 and prevents the products from entering between the back of the instruction panel 38 and the adjacent interior surface of the back panel 26.

Thus, in the automatic insertion of products into the compartment 70, the products are inserted at an angle to the open end of the compartment. As the products are inserted into the compartment 70, they engage against the upstanding or outstanding guide tab 42. The guide tab 42, being engaged by the products, guides the products smoothly into the interior of the compartment 70 until such time as the proper number of products are inserted into such compartment. Thereafter, the tab 42 is bent inward in covering relation to the open end of the compartment 70, as are the flaps 44, 48, 50 and finally 46 which then completely closes the open end of the compartment as is illustrated in FIGS. 2, 5 and 6.

From what has been described above, it will be recognized that the guide tab 42, extending beyond the instruction panel 38 of which it forms an integral part, functions as a guiding tab to enable rapid insertion of products into the interior of the compartment 70. Its enclosure within the compartment 70 is facilitated by the fold line 52. In practice it has been found that if the fold line 52 is perforated as illustrated in the drawing, the tab 42 subsequently may be removed from the instruction panel 38 at a later time so that the same will permit the proper operation of the instruction panel 38 to at least partially obstruct access to the interior of the compartment when the compartment is later opened for access to the products contained therewithin. This function will be described at a subsequent point in this disclosure.

Figure 1:
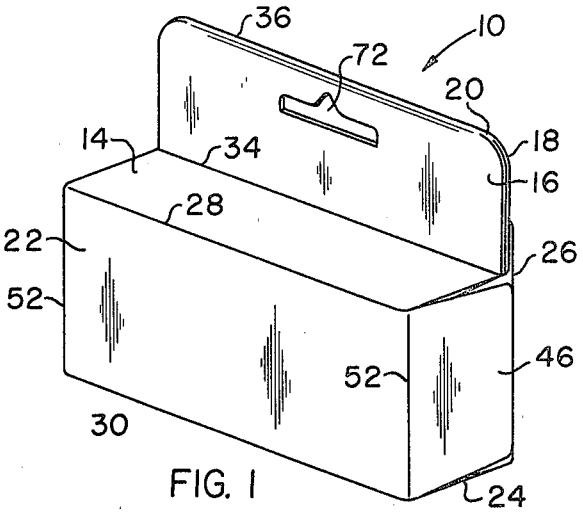
FIG. 1 is a front perspective view of a completed package constructed according to the teaching of the invention.

After the open end of the compartment 70 shown in FIG. 3 is closed, the package assumes the completed display position as is illustrated in FIG. 1, and also in FIG. 2. It is now capable of being hung from any suitable support at the support slot 72 defined and provided within the reinforcement of the double member fifth panel 20. Suitable attractive and enticing advertising material may be applied to all of the exterior surfaces of the package 10 to induce the purchase of the product contained therewithin. However, because of the personal nature of the products that may be enclosed within the package 10, it is sometimes irritating to certain segments of the public to have them displayed on such external package surfaces.

In an effort to avoid public embarrassment and/or irritation, such information now may be included on the interior of the package 10 and more particularly within the closed compartment 70 thereof hidden from view by including the same on the instruction panel 38. This is especially convenient because the instruction panel 38 is always hidden from view when the compartment 70 is closed, yet able to contain whatever instructional material may be deemed necessary to aid in the practice and use of the product contained within the compartment 70.

Access to the product within the compartment 70 is afforded simply by grasping one of the finger tabs or grips 56 provided on the tear strip 54 that forms a unitary part of the back panel 26. A tugging force applied to such finger tabs or grips 56 enables the tear strip 54 to be pulled free and separated from the back panel 26 by initially causing the separation of the tear strip from the back panel at the adjacent perforation end 62. As a continued tearing, tug or pull is applied to the tear strip 54, the same continues to separate from the back panel 26 along the perforated line 64 while also tearing free from the back panel 26 along the relatively spaced cut line 60.

The relative spacing between the lines 64 and 60, with the perforation 64 being formed on the inner surface of the back panel 26 and cut line 60 formed on the outer surface of the back panel 26, produces a delamination of the cardboard material of the back panel 26 along such respective lines of separation. The delamination requires a greater tearing force to be applied to the tear strip 54 than would a single perforation or cut line which extends more than halfway through the thickness of the material of the back panel 26.

From this it will be clear that the spaced relationship of the cut and perforation lines 60 and 64 provides an unusual benefit in the present invention. It serves as a tamper-proof arrangement of structure. That is to say, although the package 10 may be unauthorizedly tampered with, any attempt to open the package by removing the tear strip 54 along its cut and perforation lines from the back panel 26 must result in the delamination and mutilation of the back panel and the tear strip. Thus, a potential purchaser of the package 10 and the products contained therewithin will immediately see and recognize that the package has been tampered with and thereby be dissuaded from purchasing the same for fear that the products in the package have also been tampered with. Hence, one of the unique features of the present invention is in providing a package 10 which serves to afford an indication of whether there has been an attempt to tamper with the package and/or the products contained therewithin. This arrangement of structure thus serves to dissuade and deter tampering by unauthorized persons who will immediately recognize that their efforts are easily apparent, obvious and discoverable.

Figure 4:
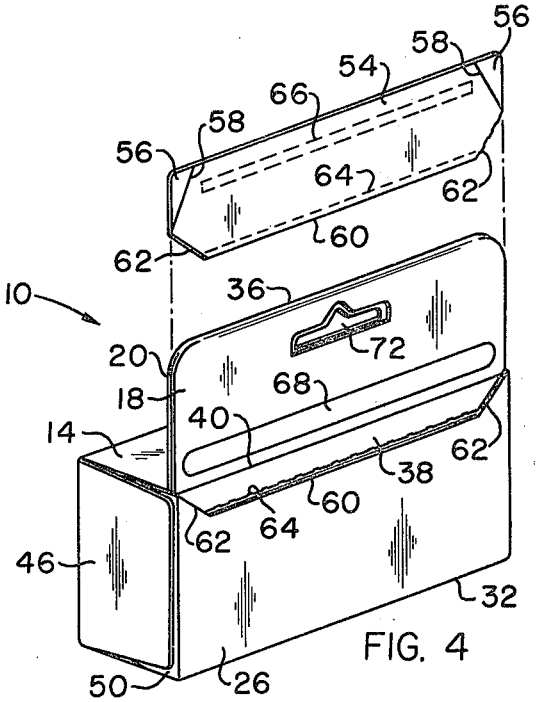
FIG. 4 is a view of the package as shown in FIG. 3 illustrating the manner of opening the package compartment by removal of the tear strip.

Complete removal of the tear strip 54 is accomplished by separating or delaminating the adhered surfaces 66 and 68 from each other in area 68. This is performed at the same time as the tear strip 54 is being torn free of its unitary relationship with the back panel 26 along the perforation lines 62 and 64, and the cut line 60. Once the tear strip 54 is removed from the panel 26 as is illustrated in FIG. 4, the fifth panel 20 now is able to be lifted so as to provide access to the interior of the compartment 70 at the top of the package in the manner as illustrated in FIG. 5.

There it will be noted that the instruction panel 38, forming an integral part of the back member 18, is lifted with the fifth panel 20 out from behind its adjacent relationship with the interior surface of the back panel 26. When so lifted into the position as shown in FIG. 5, the instruction panel 38 is immediately exposed to view by the user of the package and is in a position of at least partially obstructing access to the products of the interior of the compartment 70. As a consequence, before the user of the package can remove any of the product contents from the compartment 70, it is first necessary to displace the instruction panel 38 from its obstructing position.

This requires the user to observe the panel 38 and to read the instructive material contained thereon, which incidentally had previously been hidden within the interior of the package from view of the public. In this way, the instruction panel 38 performs an important instructive purpose of requiring the user of the package to read its contents before removing the products from the interior of the compartment 70 and assures that the information and material contained thereon will be visible at all times to the user after the compartment is opened.

After the instruction panel 38 is deflected or moved out of obstructing position and the product has been removed by the user from the compartment 70, the package 10 then may be reclosed to retain the freshness and integrity of the products remaining within compartment 70. At this time the guide tab 44 may be torn free of the instruction panel 38 at the perforation line 52 so that the guide tab 42 will not interfere with the proper function of the instruction panel 38. On the other hand, in practice it has been found that the tab 42 may be torn at the perforated line 52 and separated from the instruction panel 38 after all of the products have been inserted into the compartment 70 and before its respective open end as shown in FIG. 3 is closed. The time at which the tab 42 is removed is but a matter of choice.

To reclose the now opened package 10, it is merely necessary to bend the fifth panel 20 downward about the fold line 34 in a direction opposite to that which it had previously assumed with respect to the top panel 14 as shown in FIGS. 1 through 5 inclusive. That is to say, the fifth panel 20 now is bent about the fold line 34 in the direction as shown in FIG. 6 wherein the fifth panel 20 now serves the purpose of a closure flap as an integral extension of the top panel 14 such that it may be inserted into the compartment 70 behind and adjacent to the interior surface of the back panel 26 as shown in FIG. 6. This is done after the side flaps 44, extending from the opposite ends of the top panel 14, are removed at perforation line 52 or are inserted into the interior of the compartment 70 adjacent to and alongside the other end closure tabs 46, 48 and 50.

The reclosure of the compartment 70 and of the package 10 by the fifth panel 20 enables the fifth panel to perform a double function. In addition to serving as a display support, it also enables the same to close the package 10 at the rear thereof rather than at the front. Hence, the appearance of the reclosed package is not detracted from when it is in its reclosed position. Because the reclosure is accomplished at the back of the package and not at its front, it does not detract from the artistic value of the package.

During the reclosing operation, the instruction panel 38 folds inward along the fold line 40 so that it abuts against the inner surface of the top panel 14 as is illustrated in FIG. 6. In this way, when the package 10 is reopened by removing the fifth reclosure panel 20 from the interior of the compartment 70, the fold line 40 applies a biasing and lifting force to the instruction panel 38 causing it to rise and reassume its obstructing instructing position as shown in FIG. 5. This requires the user to move the instruction panel 38 out of its obstructing relationship to the open top of the compartment 70 before new access can be had to the products contained therewithin. Obviously it requires the user to read before physically removing the obstructing panel 38 and prior to the removal of any products from the compartment. This at least assures, in part, that the information contained on the obstructing panel 38 is always placed directly and immediately before the user of the products with the knowledge that the instructive material contained thereon will be read and followed.

Figure 10:
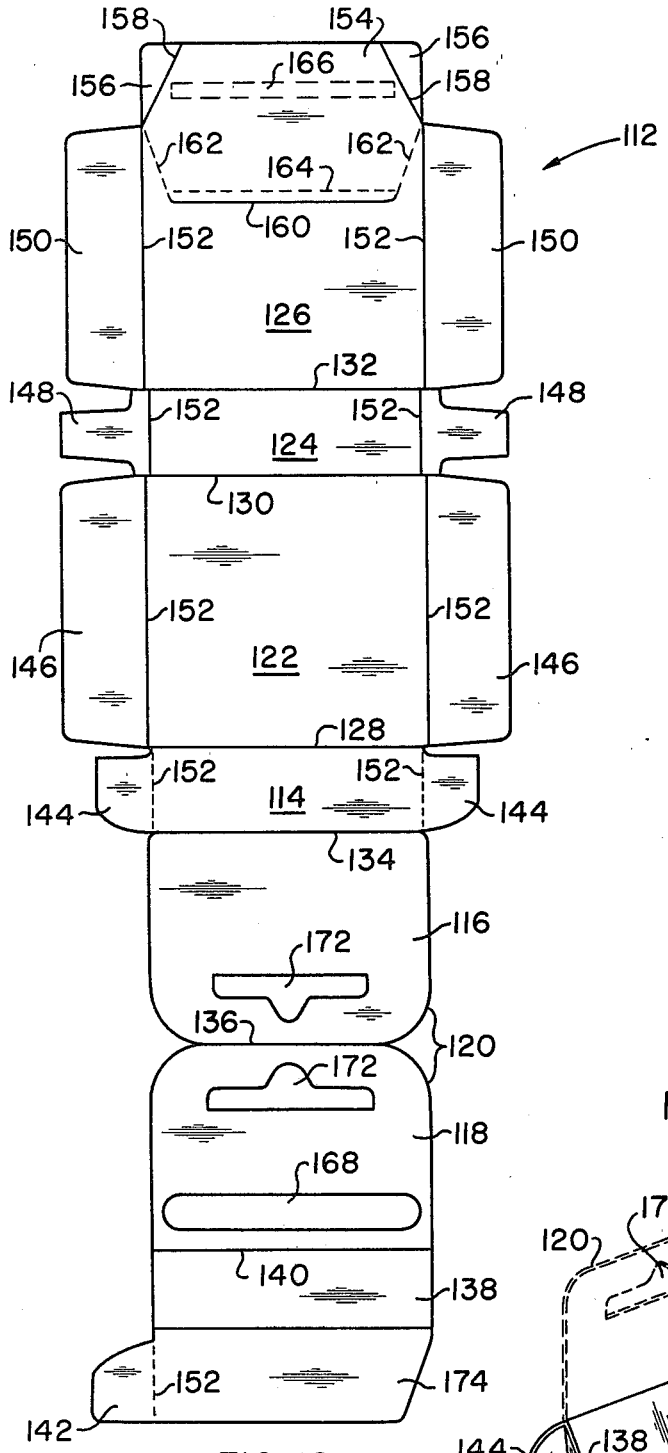
FIG. 10 is a plan view of a flat blank for construction of the package of FIGS. 8 and 9.
Figure 9:
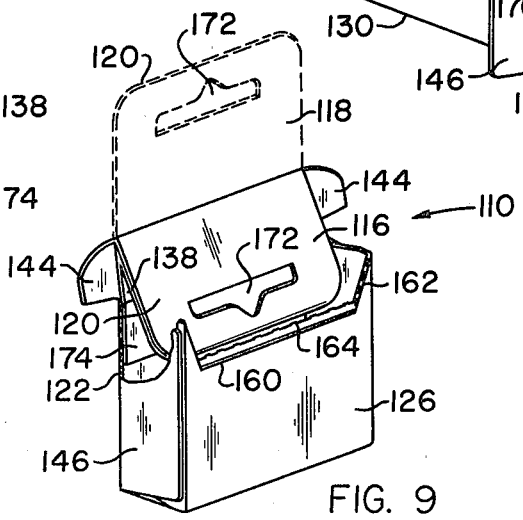
FIG. 9 is a rear perspective view of the package of FIG. 8 showing the fifth panel in reclosing position.
Figure 8:
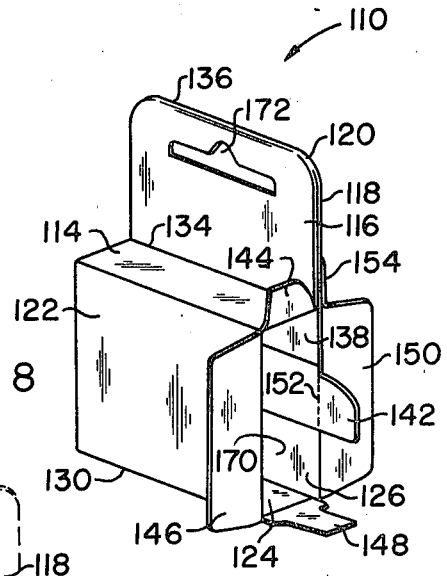
FIG. 8 is a front perspective view of a modified package with one end open.

The embodiment illustrated in FIGS. 8, 9 and 10 is essentially the same as that described with respect to the embodiment of FIGS. 1 to 7 inclusive. The two embodiments differ in that the second embodiment teaches how the invention may be applied to a smaller package for containing smaller products. For this reason, therefore, the package of the second embodiment is generally identified by the numeral 110 and all similar parts of the second embodiment corresponding to those of the first above-described embodiment are identified by like 10's numerals. The second embodiment is numbered in the 100 series with the 10's digits corresponding to the numbers of like parts of the first embodiment.

Without redescribing the whole of the package 110, it should be noted that the instruction panel 138 of the package 110 has a further extension panel 174 on which the flap or guide tab 142 is provided. Obviously the tab 142 performs the equivalent function of the tab 42 previously described. It may be separated from the extension panel 174 in the same manner as the tab 42 was able to be separated from the instruction panel 138 along the tear line 152.

The purpose of the extension panel 174 is to position the guide tab 142 into a location with respect to the compartment 170 such that products being automatically and mechanically production fed into the compartment 170 will physically engage with the guide tab 142 at a point that is approximately midway between the top and bottom panels 114 and 124. This assures that the products will engage the guide tab 142 and will be directed into the interior of the compartment 170 and will not enter between the adjacent surfaces of the instruction panel 138 and the back panel 126.

The extension panel 174 also performs a further function in that, by reason of the small size of the package 110, it may be difficult to include sufficient instructional information in graphics and type large enough to be read by the naked eye of the user of the products of the package. Therefore, the extension panel 174 combines with the instruction panel 138 to provide a larger area to include all of the necessary and desired instructional material.

In practice, the package 110 is utilized in the same manner and for the same laudable purposes as is the larger package 10. When the tear strip 154 is removed from its rear panel 126 to open the compartment 170, the instruction panel 138 and its integral extension 174 are immediately exposed to view and in obstructing access to the products in the compartment. Hence, their information must be read before they can be removed from their obstructing position.

Reclosure of the package 110 is performed in the same manner as with the package 10. In FIG. 9 the fifth panel 120 is shown in its open position by the broken lines. It is bent into its flap, reclosing position relative to the top panel 114 at the fold 134 to assume its solid line position in FIG. 9. When the fifth panel 120 is inserted into the compartment 170 behind the rear panel 126, the instruction panel 138 and its extension 174 fold into the compartment also. Hence, when the panel 120 is removed from the compartment, it lifts with it the instruction and extension panels 138 and 174 that are biased into access obstructing position to the compartment opening by the fold 140. This assures that the instructive information contained on the panels 138 and 174 will be read. The flaps 144 may be removed at their perforation lines 152 before reclosure or they may remain undisturbed to be inserted into the interior of the compartment with the fifth panel 120.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A package comprising connected front, bottom, rear and top panels and side flaps to form a closed compartment, a fifth panel comprising front and rear members extending upward from said top and rear panels, an instruction panel integral with one of said panels and extending downward into the interior of and contained within said closed compartment, a removable strip connected with one of said panels to complete the closure of said compartment, said removable strip being separable from said one of said panels to open said compartment and to expose to view said instruction panel, and said exposed instruction panel, when being exposed to view, obstructs access to said compartment to require the instructions on said instruction panel to be viewed before removing contents from said compartment.

2. A package as in claim 1, said instruction panel being located behind and adjacent to said removable strip before said strip is separated from said panel.

3. A package as in claim 2, a tab on said instruction panel having a normally operative position extending outward of an open side of said compartment before such side of said compartment is closed, said tab serving to assist in guiding the insertion of merchandise into said compartment through said open side to prevent the accidental insertion of merchandise between said instruction panel and said removable strip.

4. A package as in claim 2, said instruction panel being an integral extension of said rear member of said fifth panel, and said removable strip being an integral extension of and forming a part of said rear panel and connected with said rear member of said fifth panel.

5. A package as in claim 1, said removable strip being formed integral with and as a continuation of said rear panel and connected with said rear member of said fifth panel for separation therefrom, and said instruction panel extending downward from said rear member of said fifth panel into the closed compartment behind said removable strip such that when said removable strip is separated from its connection with said rear member it opens said compartment and immediately exposes said instruction panel in obstructing access to the interior of said compartment requiring reading of the instructions thereon.

6. A package as in claim 5, fold means between said fifth, instruction, top and front panels about which said panels move relative to each other to enable the insertion of said fifth panel into said open compartment behind said rear panel to reclose said compartment.

7. A package as in claim 6, said fold means between said instruction and fifth panel urging said instruction panel into a position at least partially obstructing the opening of said compartment when said fifth panel is removed from said compartment to reopen the same to assure viewing of the information contained on said instruction panel.

8. A package as in claim 5, and tear means on said rear panel along which said removable tear strip separates from said rear panel, said tear means including a perforated line and a continuous cut line defined in said rear panel causing the delamination of said rear panel when said removable strip is separated from its connection with said rear member of the fifth panel and from said rear panel.

9. A package for containing products to be inserted thereinto having connected top, bottom, front and rear panels, tabs at opposite ends of each of said panels to close the respective opposite ends of said package to form a closed compartment, certain of said tabs at one of the ends of said container being unsealed to leave the same open for the insertion of products into said compartment thereat, an instruction panel being positioned in the interior of said compartment, a guide tab on one of said panels and extending out of said open unsealed end of said compartment into obstructing relationship with products to be inserted into said compartment through the open end thereof so as to be engaged by the products to guide the products into said compartment through said open end to prevent the products from being inserted between said instruction panel and an adjacent panel.

10. A package as in claim 9, said instruction panel being adjacent to said rear panel in said compartment, and said guide tab being on said instruction panel.

11. A package as in claim 9, an additional extension panel integral with said instruction panel, said guide tab being on said additional extension panel.

12. A package as in claim 9, a fifth panel extending upward from and integral with said top and rear panels to form an upstanding hanger support for said package, said instruction panel being a unitary extension of said fifth panel into said compartment.

13. A package as in claim 12, releasable means connecting said fifth and rear panels together and removable from at least one of said fifth and rear panels to enable the separation of the connection therebetween to expose said instruction panel to view in said compartment prior to access to the products contained in said compartment.

14. A package as in claim 13, fold means between said top, fifth and instruction panels about which the same move relative to each other to permit the insertion of said fifth panel into said compartment to close the same and for the removal therefrom to open the same, said instruction panel being moved into at least a partial obstructing position with relation to the opening of said compartment.

15. A package comprising a closed compartment with connected fifth, instruction and rear panels, said instruction panel extending from said fifth panel into said closed compartment for obstructing access to said compartment when said compartment is opened, said rear panel comprising a removable tear strip, said tear strip being sealed to said fifth panel to connect together said rear panel and said fifth panel to complete said closed compartment and the removal of said tear strip from at least one of said rear and fifth panels opens said closed compartment to expose said instruction panel.

16. A package as in claim 14, said instruction panel being positioned in the interior of said closed compartment and adjacent to said rear panel, and said tear strip is removable from said fifth and rear panel to open said compartment to expose said instruction panel which at least partially obstructs removing products from said compartment until said fifth panel is moved relative to said open compartment to displace said instruction panel from its obstructing position.

17. A package as in claim 14, said tear means comprising a cut line and a perforated line spaced from each other such that removal of said tear strip requires a substantial deliberate force that mutilates said tear means and prevents accidental opening of said closed compartment and alerts the user of prior tampering with the package.

18. A package having top, fifth, and rear panels sequentially connected together to form a closed compartment, said top panel being connected with said fifth panel by fold means, and means releasably connecting said fifth and rear panels together to open said package therebetween so that said fifth panel may fold relative to said top panel at said fold means to be tucked into said compartment opening to reclose said compartment behind said rear panel.

19. A package as in claim 18, said fifth panel including joined front and rear members each containing holes that align when said front and rear members of said fifth panel are joined to allow said package to be hung on display at said holes.

20. A package as in claim 19, and an instruction panel forming an integral extension of said rear member and extending therefrom into said compartment to obstruct access to the same when said compartment is open.

* * * * *